US007743856B2

(12) United States Patent
McGuire et al.

(10) Patent No.: US 7,743,856 B2
(45) **Date of Patent: *Jun. 29, 2010**

(54) SLIP SPOOL ASSEMBLY AND METHOD OF USING SAME

(75) Inventors: Bob McGuire, Moore, OK (US); L. Murray Dallas, Fairview, TX (US); Irwin Rosenhauch, Edmonton (CA)

(73) Assignee: Stinger Wellhead Protection, Inc., Oklahoma City, OK (US)

( * ) Notice: Subject to any disclaimer, the term of this patent is extended or adjusted under 35 U.S.C. 154(b) by 31 days.

This patent is subject to a terminal disclaimer.

(21) Appl. No.: 12/106,440

(22) Filed: Apr. 21, 2008

(65) Prior Publication Data

US 2008/0196882 A1 Aug. 21, 2008

Related U.S. Application Data

(63) Continuation of application No. 11/182,367, filed on Jul. 15, 2005, now Pat. No. 7,392,864.

(51) Int. Cl.
*E21B 19/10* (2006.01)

(52) U.S. Cl. ..... 175/423; 166/88.2; 166/77.52; 166/382

(58) Field of Classification Search ..... 166/88.2–888.4, 166/89.3, 382; 175/423
See application file for complete search history.

(56) References Cited

U.S. PATENT DOCUMENTS

| | | | | |
|---|---|---|---|---|
| 2,194,265 | A | 3/1940 | Abercrombie | 285/3 |
| 2,563,851 | A | 8/1951 | Lundeen et al. | 175/423 |
| 2,909,380 | A | 10/1959 | Hoye, et al. | 285/333 |
| 3,090,640 | A | 5/1963 | Otteman | 285/3 |
| 4,127,927 | A | 12/1978 | Hauk et al. | 29/407 |
| 4,244,093 | A | 1/1981 | Klingensmith | 29/256 |
| 4,281,535 | A | 8/1981 | Wesch, Jr. | 73/49.8 |
| 4,638,972 | A * | 1/1987 | Jones et al. | 251/1.3 |
| 4,646,827 | A | 3/1987 | Cobb | 166/88.2 |
| 4,681,193 | A | 7/1987 | Crowe | 188/67 |
| 4,715,456 | A | 12/1987 | Poe, Jr. et al. | 175/423 |
| 4,770,448 | A | 9/1988 | Strickland et al. | 285/333 |
| 4,860,826 | A | 8/1989 | Land | 166/80 |
| 4,940,118 | A | 7/1990 | Cox | 188/67 |
| 5,012,865 | A | 5/1991 | McLeod | 166/90 |
| 5,027,926 | A | 7/1991 | Cox | 188/67 |
| 5,515,925 | A | 5/1996 | Boychuk | 166/379 |
| 5,515,926 | A | 5/1996 | Boychuk | 166/379 |
| 5,522,464 | A | 6/1996 | Piper | 166/77.2 |
| 5,590,867 | A | 1/1997 | Van Winkle | 251/1.3 |
| 5,785,121 | A | 7/1998 | Dallas | 166/90.1 |

(Continued)

*Primary Examiner*—Giovanna C Wright
(74) *Attorney, Agent, or Firm*—Nelson Mullins Riley & Scarborough, LLP

(57) ABSTRACT

A slip spool includes radially disposed actuators for radially moving slip blocks between a loose encirclement position in which they surround the tubing string and a cached position in which the slip blocks clear an axial passage of the slip spool. The slip spool further includes axially disposed actuators for axially displacing the slip blocks between the loose encirclement position and an engagement position in which the slip blocks are seated within a slip bowl of the slip spool so that a weight of the suspended tubing string causes the slip blocks to tightly grip the tubing string. The slip spool facilitates positioning and repositioning of the tubing string in the wellbore and can be used for supporting or snubbing a tubing string in a live well bore.

20 Claims, 12 Drawing Sheets

U.S. PATENT DOCUMENTS 5,819,851 A 10/1998 Dallas ..... 166/308
5,988,274 A 11/1999 Funk ..... 166/77.4
6,019,175 A 2/2000 Haynes ..... 166/382
6,145,596 A 11/2000 Dallas ..... 166/379
6,209,633 B1 4/2001 Haynes ..... 166/72
6,220,363 B1 4/2001 Dallas ..... 166/382
6,234,253 B1 5/2001 Dallas ..... 166/377
6,289,993 B1 9/2001 Dallas ..... 166/386
6,364,024 B1 4/2002 Dallas ..... 166/379
6,412,560 B1 7/2002 Bernat ..... 166/301
6,595,297 B2 7/2003 Dallas ..... 166/382
6,626,245 B1 9/2003 Dallas ..... 166/379
6,695,064 B2 2/2004 Dallas ..... 166/382
6,712,147 B2 3/2004 Dallas ..... 166/379
6,769,489 B2 8/2004 Dallas ..... 166/386
6,817,421 B2 11/2004 Dallas ..... 166/379
6,817,423 B2 11/2004 Dallas ..... 166/382
6,827,147 B2 12/2004 Dallas ..... 166/379
6,918,439 B2 7/2005 Dallas ..... 166/377
6,938,696 B2 9/2005 Dallas ..... 166/377
6,948,565 B2 9/2005 Dallas ..... 166/380
7,159,663 B2 1/2007 McGuire et al. ..... 166/379
7,204,474 B2 4/2007 McGuire et al.
7,207,384 B2 4/2007 Dallas et al. ..... 166/250.07
7,213,641 B2 5/2007 McGuire et al.
7,270,190 B2 * 9/2007 McWhorter et al. ..... 166/382

* cited by examiner

SLIP SPOOL ASSEMBLY AND METHOD OF USING SAME

RELATED APPLICATIONS

This application is a continuation of U.S. patent application Ser. No. 11/182,367 filed Jul. 15, 2005.

FIELD OF THE INVENTION

The present invention relates to slip assemblies and, in particular, to a slip spool used to selectively support or snub a tubing string during a live well operation.

BACKGROUND OF THE INVENTION

In the oil industry, slips have been essential components of oil field drilling and servicing equipment for many years. Conventional manual slips are sets of heavy hinged blocks with gripping dies that are positioned in a slip bowl of a rotary table to engage a drill pipe, casing or production tubing. Angled surfaces in each slip block mate with complementary surfaces in the slip bowl. The complementary surfaces cause axial forces exerted by the weight of the pipe on the gripping dies to be transferred into lateral gripping pressure on the pipe, which supports the pipe and thus prevents it from dropping into the well when a free end of the pipe is released for any reason.

As is well known in the art, conventional slips are often manually engaged by oil field personnel who physically maneuver the slips into the slip bowl so that they slide into engagement with the casing or drill pipe. The slips are disengaged by upward axial movement of the casing, drill pipe, or production tubing to take the weight off the slips. The slips are then lifted out of the slip bowl. An example of such conventional slips is described in U.S. Pat. No. 4,244,093, which is entitled TUBING SLIP PULLING TOOL and issued to Klingensmith on Jan. 13, 1981.

There is an ever-increasing demand for obtaining more oil and gas from existing wells. After a primary recovery term of a well has elapsed, some form of reworking is required to remove residual oil and/or gas from the well. Usually in reworking those wells, such as in preparation for a well stimulation process, the tubing string must be removed from the well or pulled up for attachment of wellhead tools, and then lowered again to insert the wellhead tools through the wellhead. During such operations, the tubing string is typically secured by slips. It is therefore necessary to remove and set the slips in preparation for a well stimulation process. Consequently, slips are not only frequently used during well drilling and completion; they are also required equipment for well re-completion, servicing and workover.

However, manual handling of slips can be dangerous and time-consuming. Accordingly, hydraulically powered equipment has been introduced for positioning slips. An example of a hydraulically operated slip assembly used to grip pipe as it is being run into or pulled from a well is described in U.S. Pat. No. 5,027,926 entitled SLIP ASSEMBLY, which issued to Cox on Jul. 2, 1991. However, Cox does not provide any pressure containment.

There is therefore a need for a slip spool that facilitates the setting and resetting of a tubing string in a live well bore.

SUMMARY OF THE INVENTION

An object of the invention is to provide a slip spool that facilitates the task of positioning or repositioning a tubing string in a live well bore. The slip spool radially and axially displaces slip blocks for supporting the tubing, thereby enabling the slip spool to selectively grip and release the tubing string, while providing full bore access to the well bore.

The invention therefore provides a slip spool that selectively supports or snubs a tubing string in a wellbore under pressure, the slip spool comprising: a slip spool body that is mounted to a wellhead, the slip spool body having an axial passage with a slip bowl formed in the axial passage, and at least two radial passages communicating with the axial passage; a slip block assembly displaceably supported within each radial passage and displaceable from a cached position in which the slip block assembly clears the axial passage and an engaged position in which slip blocks of the slip block assembly are seated in the slip bowl and cooperate with slip blocks of at least one other slip block assembly to grin the tubing string; and actuators that are operated to displace each slip block assembly from the cached position to the engaged position, and from the engaged position to the cached position.

The invention further provides a slip block assembly for a slip spool, comprising in combination: a slip control arm with a transverse T-slot in an outer end thereof that slidably receives an end plate connected to a radial actuator that radially displaces the slip block assembly, and an internal longitudinal slot though which extends a lift rod of an axial actuator that axially displaces the slip block assembly, whereby the T-slot and the longitudinal slot decouple axial and radial movement so that the radial actuator can be operated independently of the axial actuator; and at least one slip block connected to an end of the slip control arm and cooperating with at least one other slip block assembly to grip a tubing string that extends through an axial passage in a slip spool body of the slip spool when the slip blocks are displaced into a slip bowl in the axial passage.

Other advantages and features of the invention will be better understood with reference to preferred embodiments of the invention described hereinafter.

BRIEF DESCRIPTION OF THE DRAWINGS

Having thus generally described the nature of the invention, reference will now be made to the accompanying drawings, showing by way of illustration the preferred embodiments thereof, in which.

DETAILED DESCRIPTION OF THE PREFERRED EMBODIMENTS

In general, and as will be explained below, a slip spool for supporting a tubing string in a wellbore includes radially disposed actuators for radially moving slip blocks between a disengaged encirclement position in which they surround the tubing string and a cached position in which the slip blocks clear an axial passage of the slip spool. The slip spool further includes axial actuators for axially displacing the slip blocks between an upper, disengaged encirclement position and a lower, engaged position in which the slip blocks are seated within a slip bowl of the slip spool and a weight of the encircled tubing string causes the slip blocks to tightly grip the tubing string to support it. The slip spool facilitates positioning and repositioning of the tubing string in a live well bore and thus expedites well servicing operations.

Figure 1A:
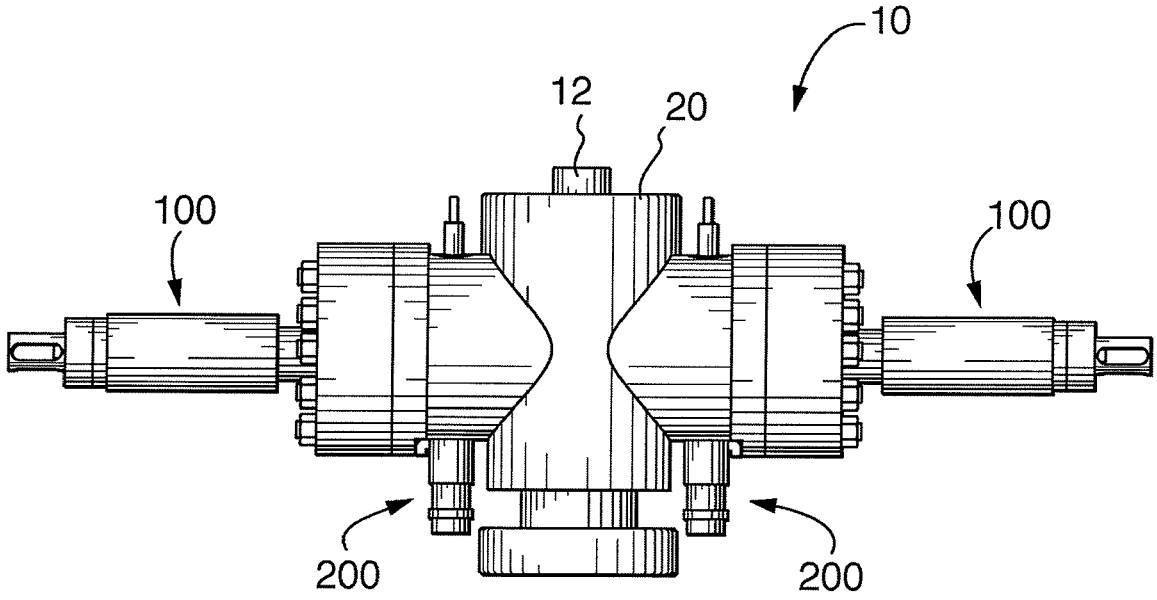
FIG. 1*a* is a front elevational view of one embodiment of a slip spool in accordance with the invention.

FIG. 1*a* is a front elevation view of a slip spool 10 in accordance with one embodiment of the invention. The slip spool 10 includes a slip spool body 20, a mechanism, e.g. radial actuators 100, for radially displacing the slip blocks, as will be described in more detail below, relative to the slip spool body 20, and a mechanism, e.g. axial actuators 200, for axially displacing the slip blocks relative to the slip body 20. Accordingly, the slip spool 10 includes two orthogonal sets of actuators for displacing the slip blocks over a limited range of movement in both the radial and axial directions. The radial and axial actuators permit an operator to selectively support a tubing string 12 in a live well bore.

Figure 1B:
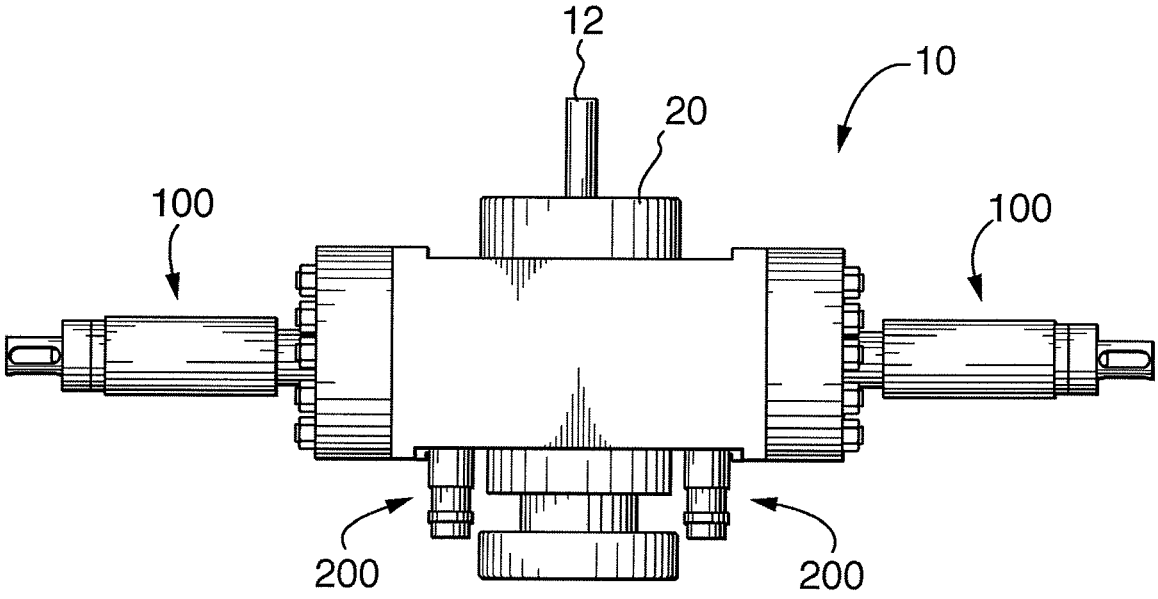
FIG. 1*b* is a front elevational view of another embodiment of a slip spool in accordance with the invention.

FIG. 1*b* is a front elevational view of another embodiment of a slip spool 10 in accordance with the invention. The slip spool 10 shown in FIG. 1*b* is identical in all respects to the embodiment shown in FIG. 1*a*, with the exception that the slip body 20 is rectangular in cross-section for increased pressure resistance. Consequently, this embodiment of the slip spool 10 can be used for high-pressure applications where working pressures are likely to exceed 3,000 psi. In all other respects the embodiments shown in FIGS. 1*a* and 1*b* are identical and in the explanation that follows, the slip spool 10 refers to both embodiments and FIG. 1 refers inclusively to both FIGS. 1*a* and 1*b*.

Figure 2:
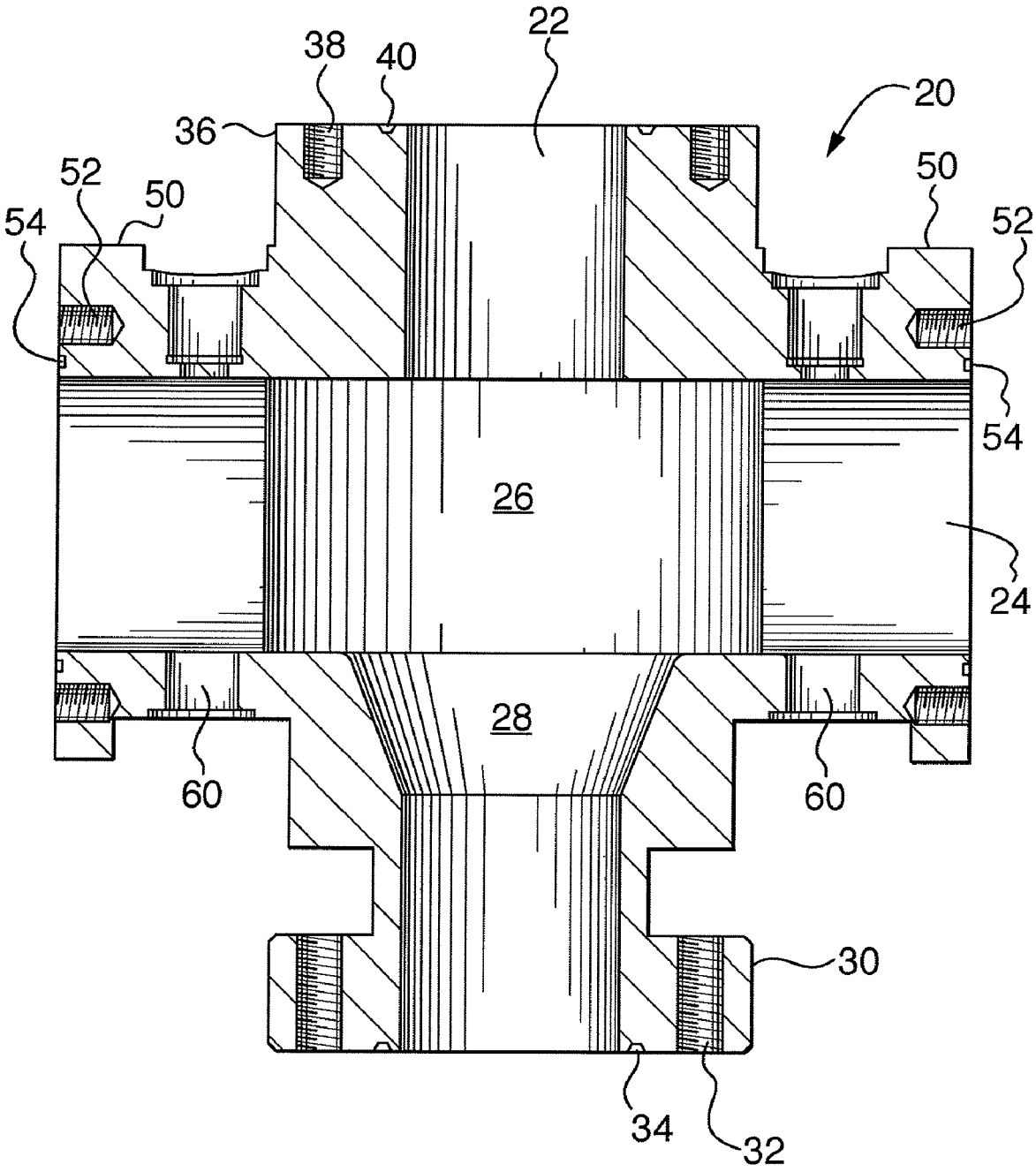
FIG. 2 is a cross-sectional view of a slip spool body of the slip spool shown in FIG. 1.

The slip spool body 20 is illustrated in greater detail in the cross-sectional view shown in FIG. 2. The slip spool body 20 has an axial passage 22 which is aligned with a wellbore and which provides full-bore access when the slip spool is mounted to a wellhead, as described in Applicant's U.S. Pat. No. 6,695,064 entitled SLIP SPOOL AND METHOD OF USING SAME which issued Feb. 24, 2004 and which is hereby incorporated by reference.

As shown in FIG. 2, the slip spool 10 includes at least two radial passages 24 that extend through the side walls of the slip spool body 20 and communicate with the axial passage 22. As will be described in greater detail below, slip actuator arms are slidably supported in the respective radial passages. The slip spool body 20 also includes a slip cache cavity 26 to permit the slips to clear the axial passage 22 when retracted to a cached position, in order to provide the full-bore access to the well. Below the slip cache cavity is a funnel-shaped slip bowl 28 into which the slip blocks are lowered in an engaged position in which they tightly grip the tubing string, as will be explained below.

As further shown in FIG. 2, the slip spool body 20 includes a bottom flange 30 having a plurality of equidistantly spaced bores 32 dimensioned to receive flange bolts (not shown) for securing the slip spool body 20 to a top of another spool, such as a blowout preventer (BOP) or the like. The bottom flange 30 also includes an annular groove 34 for receiving a metal ring gasket (not shown) for providing a fluid-tight seal between the bottom flange 30 and any other flanged component to which it is mounted.

The slip spool body 20 also includes a stud pad 36 at a top of the slip spool body. The stud pad 36 includes a plurality of equidistantly spaced, tapped bores 38 for receiving "studs" (not shown) for mounting another spool, Bowen union, adapter or other component to the top of the slip spool body 20. The stud pad 36 also includes an annular groove 40 for receiving a metal ring gasket (not shown) for providing a fluid-tight seal between the top of the slip spool body 20 and any other component mounted thereto.

As further shown in FIG. 2, the slip spool body 20 includes a pair of opposed side flanges 50 surrounding each of the radial passages 24. The side flanges 50 each include a plurality of equidistantly spaced bores 52 which are tapped to receive and engage studs or other threaded fasteners (not shown). Each of the side flanges 50 also includes an annular groove 54 for receiving an annular sealing element (not shown) for providing a fluid-tight seal between the side flanges 50 and respective end plates that will be described below. The slip spool body 20 also includes a pair of spaced-apart, axially aligned bores 60 intersecting the respective radial passages 24, the bores 60 being dimensioned to receive the respective axial actuators 200.

Figure 3:
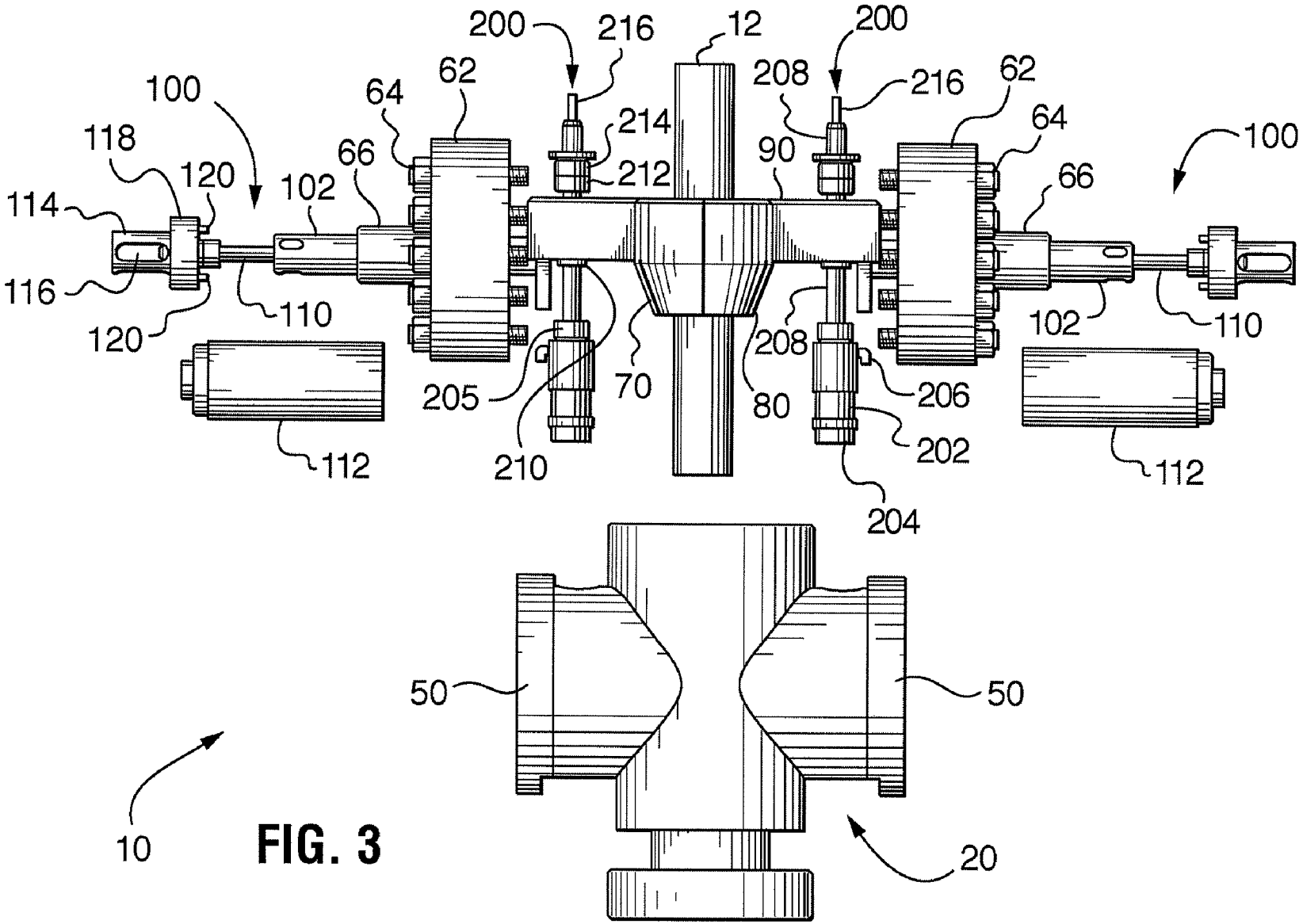
FIG. 3 is a partially exploded view of the slip spool shown in FIG. 1*a;*

FIG. 3 illustrates an elevational, partially exploded view of the slip spool 10. As shown in FIG. 3, the radial actuators 100 are connected to the slip spool body 20 by end plates 62 that are secured to respective side flanges 50 of the slip spool body 20 by a plurality of stud fasteners 64. The radial actuators 100 are mounted in sockets 66 in the end plates 62. The radial actuators radially displace a pair of opposed slip block assemblies 70, 80 relative to the slip spool body 20. Likewise, the axial actuators 200 are mounted within the bores 60 shown in FIG. 2 for axially displacing the slip block assemblies 70, 80 relative to the slip spool body 20.

As will be explained below, each slip block assembly 70, 80 includes at least one slip block but preferably includes a plurality of interconnected slip blocks shaped to fit snugly within the slip bowl 28 shown in FIG. 2. As will also be explained below, the slip blocks of the opposed slip block assemblies 70, 80 encircle and grip the tubing string 12 to suspend the tubing string 12 in a live well bore and this facilitate positioning and repositioning of the tubing string 12 in the live well bore.

As shown in FIG. 3, each of the radial actuators 100 includes a hydraulic cylinder that includes parts 66,112 that operate under hydraulic pressure to displace a piston 102 and an associated piston rod 104 (FIG. 4) that are in turn connected to one of the opposed slip block assemblies 70, 80. Each radial actuator 100 includes an indicator rod 110 that is connected to the piston on a side opposite the piston rod and is displaced by movement of the piston 102 and piston rod 104. The indicator rod 110 is partially protected by a protective shroud 114. Connected to the protective shroud 114 is a flanged end cap 118 having an oblong aperture 116 for viewing a position of the indicator rod 110. The end cap 118 includes an inwardly facing flange having a plurality of bores dimensioned to receive fasteners 120 for detachably securing the flanged end cap 118 to the protective shroud 114. The flanged end cap 118 is thus fixed with respect to the end plate 62 by part 112. The oblong aperture 116 in the flanged end cap 118 is dimensioned to correspond to a range of travel of each radial actuator 100. Gradations or other marks can be inscribed on the end cap 118 above or below the oblong aperture 116 in order to indicate the displacement of the slip blocks relative to the axial centerline or relative to tubing strings of various diameters. The indicator rods can therefore be used to verify that the slip blocks are in gripping contact with a given diameter of a tubing string.

As further shown in FIG. 3, each of the axial actuators 200 (or "lift actuators") includes a hydraulic cylinder 202 with an end cap 204. An upper end 205 of each hydraulic cylinder 202 is received within lower bores 60 of the slip spool body 20 shown in FIG. 2. Each axial actuator 200 includes an elbow 206 for monitoring pressure leaks. Under hydraulic pressure introduced through a hydraulic port (not shown) in a bottom end of each hydraulic cylinder 202, a piston 208 serves as a lift rod having a flange 210. The flanges 210 engage a pair of slip control arms 90 respectively connected to the slip block assemblies 70, 80, as will be explained below. Each axial actuator 200 also includes a lift rod centralizer and seal support 212 and a flanged lift indicator cover 214 that is housed within an upper bore 60 of the slip spool body 20 shown in FIG. 2. Protruding from the top of each axial actuator is a lift indicator rod 216 which provides a visual indication of the axial (or vertical) displacement of the slip blocks relative to the slip spool body 20. Gradations or other markings can be inscribed on the lift indicator rods 216 in order to facilitate the task of monitoring movement of the slip blocks 70,80.

Figure 4:
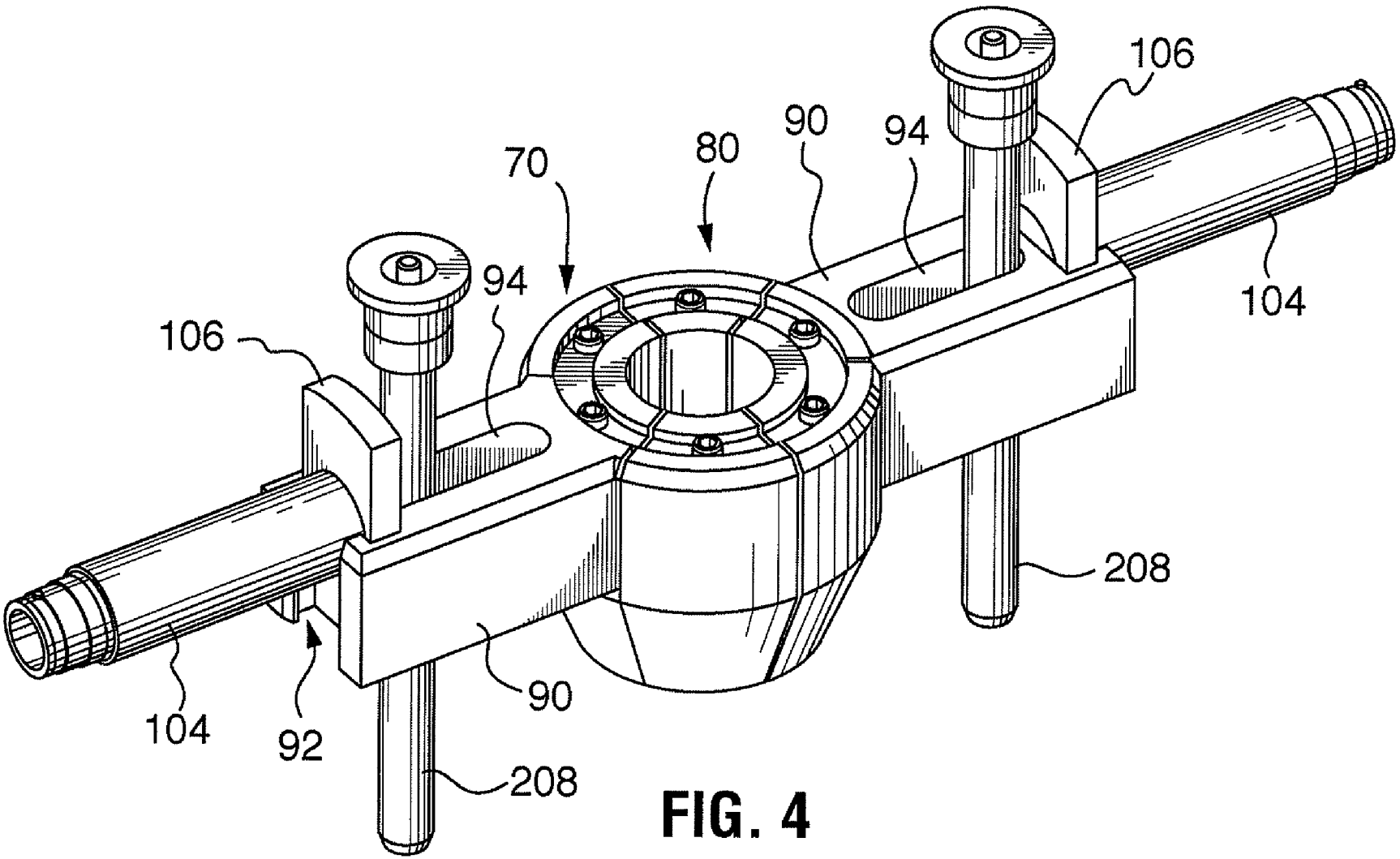
FIG. 4 is an isometric perspective view of slip block and actuating arm subassembly, showing a transverse T-slot and a longitudinal slot in the actuating arm for decoupling radial and axial movement of the slip blocks.

As illustrated in FIG. 4, each of the two opposed radial actuators 100 (FIG. 3) drives a piston rod 104 affixed to an end plate 106 that slides within a transverse T-slot 92 in each of the slip control arms 90. Each slip control arm 90 also has an internal longitudinal slot 94 through which extends a lift rod 208 of one of the axial actuators 200. The T-slots 92 and the longitudinal slots 94 effectively decouple axial and radial movement so that the radial actuators can be operated independently of the axial actuators, and vice versa. The slip blocks can thus be displaced radially over a limited range of movement delimited by a length of the longitudinal slot 94. Similarly, the slip blocks 70,80 can be displaced axially within a limited range of movement limited by the vertical play within the radial passages 24. Consequently, the axial actuator 200 and radial actuators 100 are independently operable within respective limited ranges of motion to permit the slip blocks to be moved into and out of the slip bowl 28.

As will be readily appreciated by those skilled in the art, the mechanism 100 for radially moving the slip block assemblies and the mechanism 200 for axially moving the slip block assemblies need not be hydraulic cylinders. For example, mechanical screws can be used, as was described in Applicant's U.S. Pat. No. 6,695,064. Alternatively, the mechanism for radially moving the slip block assemblies may be pneumatic actuators, while the means for radially moving the slip block assemblies can be either hydraulic actuators or mechanical screws.

Figure 5:
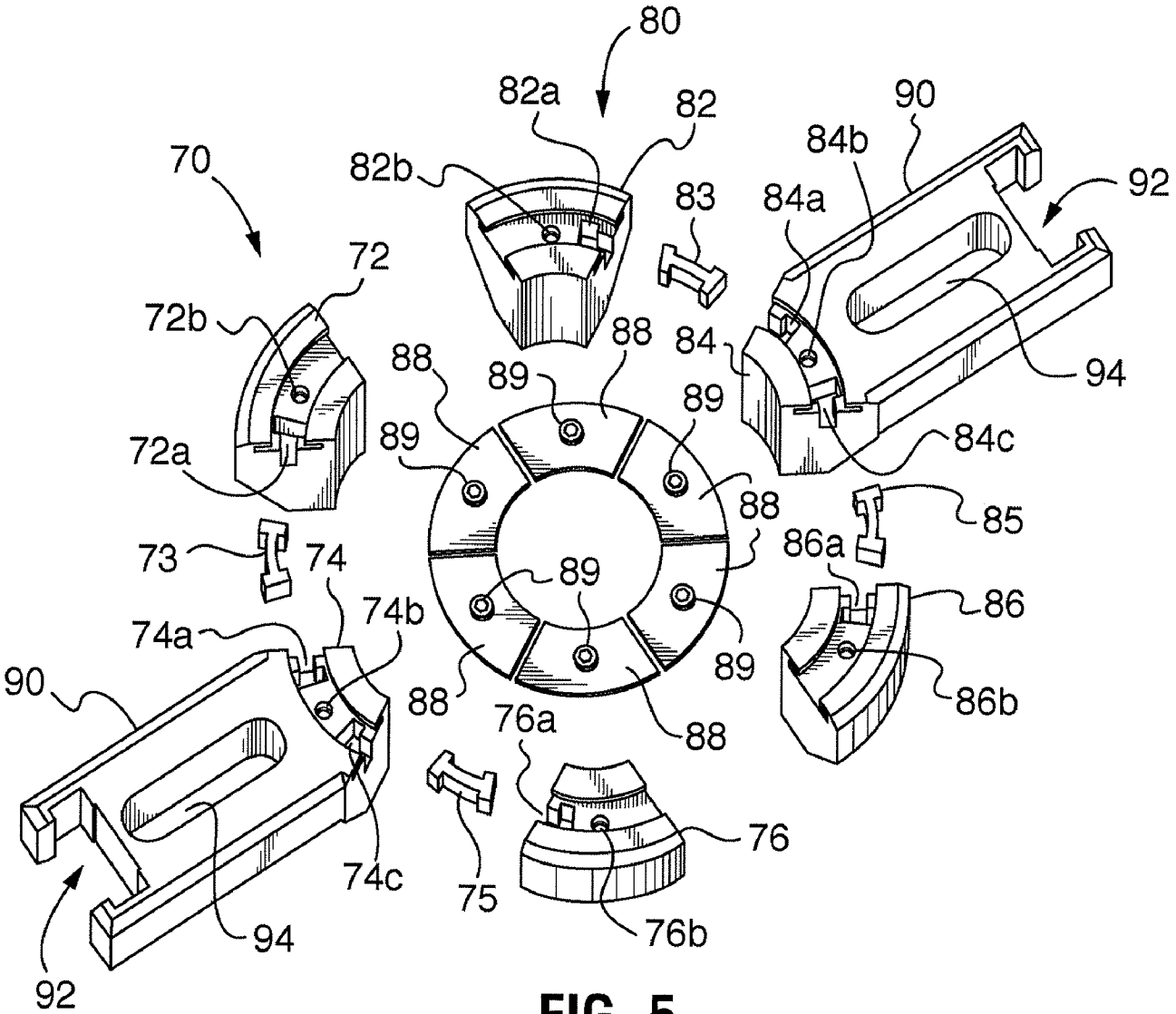
FIG. 5 is an exploded view of the subassembly shown in FIG. 4.

FIG. 5 is an exploded view of the slip control arms 90 and slip block assemblies 70, 80 shown in FIG. 4. As shown in FIGS. 4 and 5, each of the opposed slip block assemblies 70, 80 includes three segmented, articulated slip blocks that come together in the slip bowl 28 to form a 360-degree slip capable of supporting a tubing string.

As best shown in FIG. 5, in one embodiment a first slip block assembly 70 includes three, wedge-shaped slip blocks 72, 74, 76. A pair of side slip blocks 72, 76 are loosely connected to opposite sides of the center slip block 74. In one embodiment, the center slip block 74 is integrally formed with the slip control arm 90 at an end opposite the T-slot 92. The side slip blocks 72 and 76 are moveably connected to the center slip block by interlock bars 73, 75. The first interlock bar 73 fits loosely within slots 72*a* and 74*a* while the second interlock bar 75 fits loosely within slots 74*c* and 76*a*. A retainer plate 88 (cover plate) is received in a T-slot in a top of each slip block 74 and retained in the T-slot by a threaded fastener 89, which engages threads in a tapped bore 74*b*. Corresponding retainer plates 88 are received in T-slots in a top surface of slip blocks 72 and 76. The retainer plates 88 retain the interlock bars 73, 75 within their respective adjacent slots to provide an articulated slip block assembly 70.

Similarly, the second slip block assembly 80 includes three wedge-shaped slip blocks 82, 84, 86. The center slip block 84 is loosely connected to the adjoining side slip blocks 82 and 86 by interlock bars 83 and 85, respectively. The third interlock bar 83 fits loosely within slots 82*a* and 84*a* while the fourth interlock bar 85 fits loosely within slots 84*c* and 86*a*. A retainer plate 88 is secured to each of the three slip blocks 82, 84, 86 by respective threaded fasteners 89, which engage threads in tapped bores 82*b*, 84*b*, and 86*b*. The retainer plates 88 retain the interlock bars within their slots so that the slip blocks 82, 84, 86 are loosely interconnected. As will be explained below, loose interconnection of adjoining slip blocks enables the slip blocks to first loosely encircle a tubing string and then to grip the tubing string as the slip blocks seat tightly into the slip bowl 28.

Figure 6:
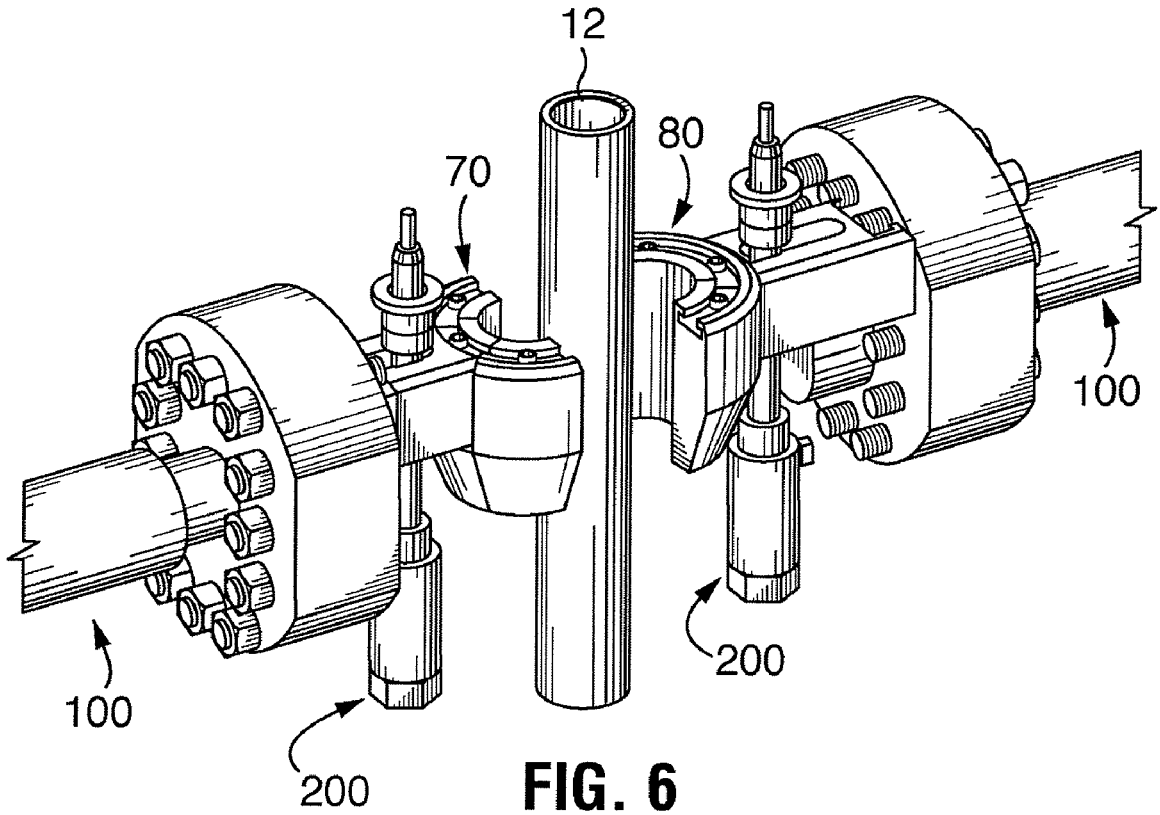
FIG. 6 is an isometric perspective view of the slip blocks in a retracted position.
Figure 7:
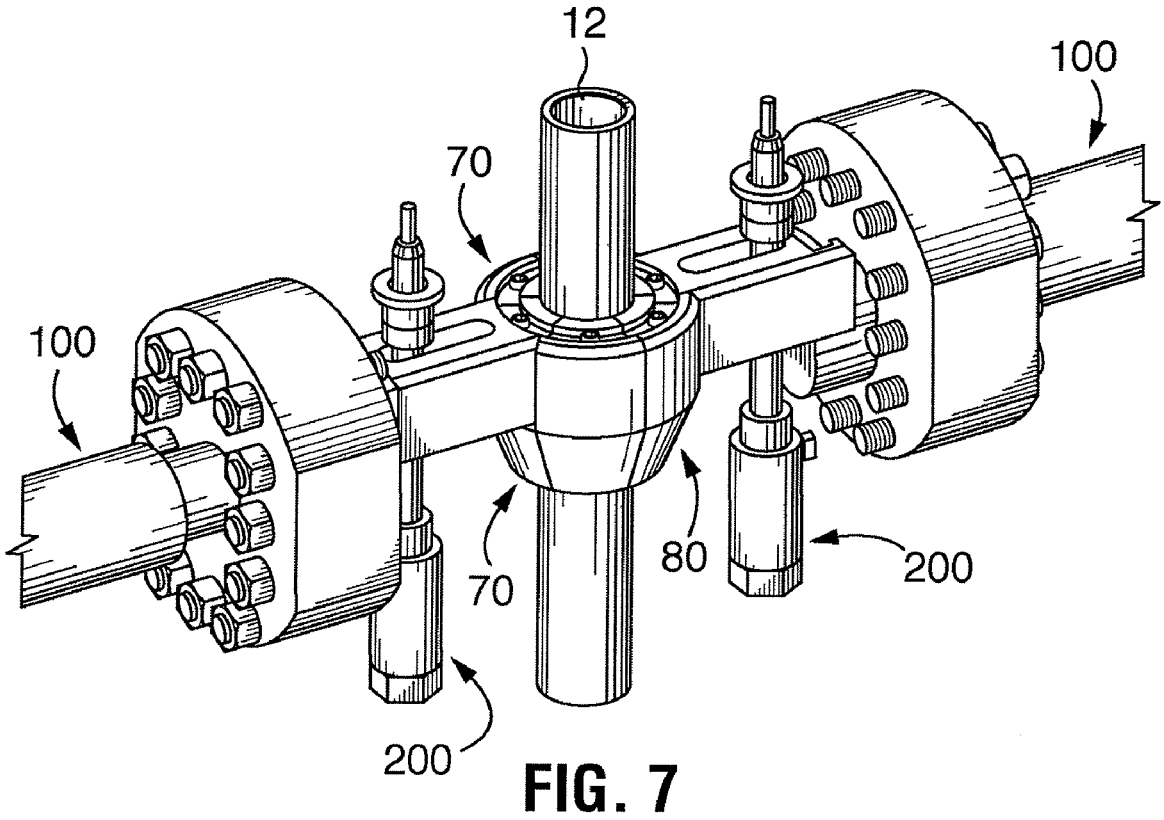
FIG. 7 is an isometric perspective view of the slip blocks in a disengaged encirclement position.
Figure 8:
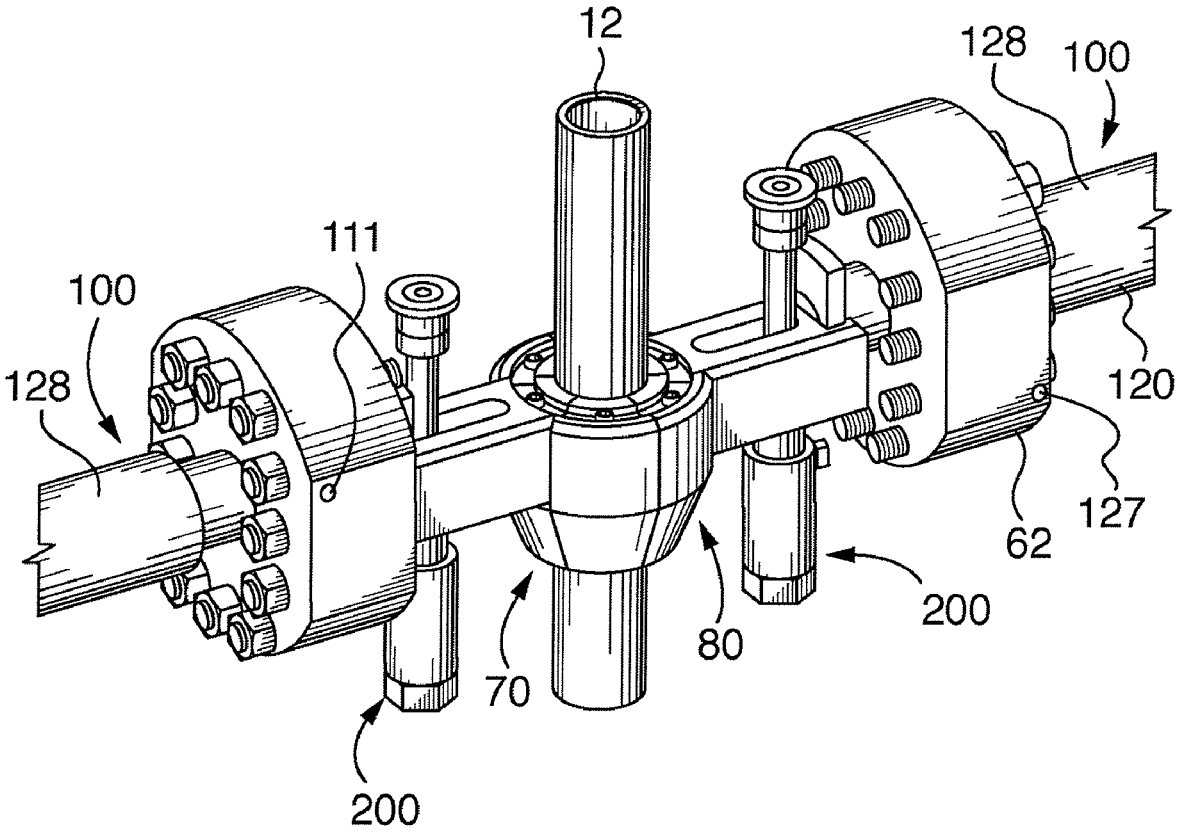
FIG. 8 is an isometric perspective view of the slip blocks in an engaged gripping position after being lowered into the slip bowl.

FIGS. 6 to 8 illustrate the operation of the slip spool. As shown in FIG. 6, the opposed slip block assemblies 70, 80 are in a retracted position in which the slips clear the axial passage to provide full-bore access to the well through the axial passage. When actuated, the radial actuators 100 move the slip block assemblies 70, 80 into a loose encirclement position shown in FIG. 7. Finally, as shown in FIG. 8, the axial actuators 200 lower the slip block assemblies 70, 80 into the slip bowl 28. The weight of the tubing string 12 causes the slip block assemblies 70, 80 to slide downwardly into the converging space in the slip bowl 28, which forces the slip block assemblies 70, 80 to tightly grip the tubing string 12 and suspend it in the well bore. To remove the tubing string 12 from the slip blocks, the weight of the tubing string 12 is supported by rig, or the like, to release the slip block assemblies 70, 80. The axial actuators 200 are then operated to lift the slip blocks out of the slip bowl 28 to the loose encirclement position shown in FIG. 7. The slip blocks 70, 80 are then moved out of the central passage 22 by operating the radial actuators 100 to retract the slip block assemblies 70, 80 to the cached position.

This slip spool 10 can be utilized for any one of variously sized tubing strings by simply replacing the slip block assemblies 70, 80 with assemblies that accommodate the diameter of the tubing. For example, the slip block assemblies 70, 80 described above could be used for 4.5" tubing string. For a smaller tubing string, such as 2.38" tubing, it is advantageous to employ slip blocks having pipe guides to guide the tubing toward a center of the axial passage. Were the tubing to be substantially misaligned when the slip block assemblies 70, 80 are moved to the loose encircling position, the tubing could be deformed or damaged.

Figure 9:
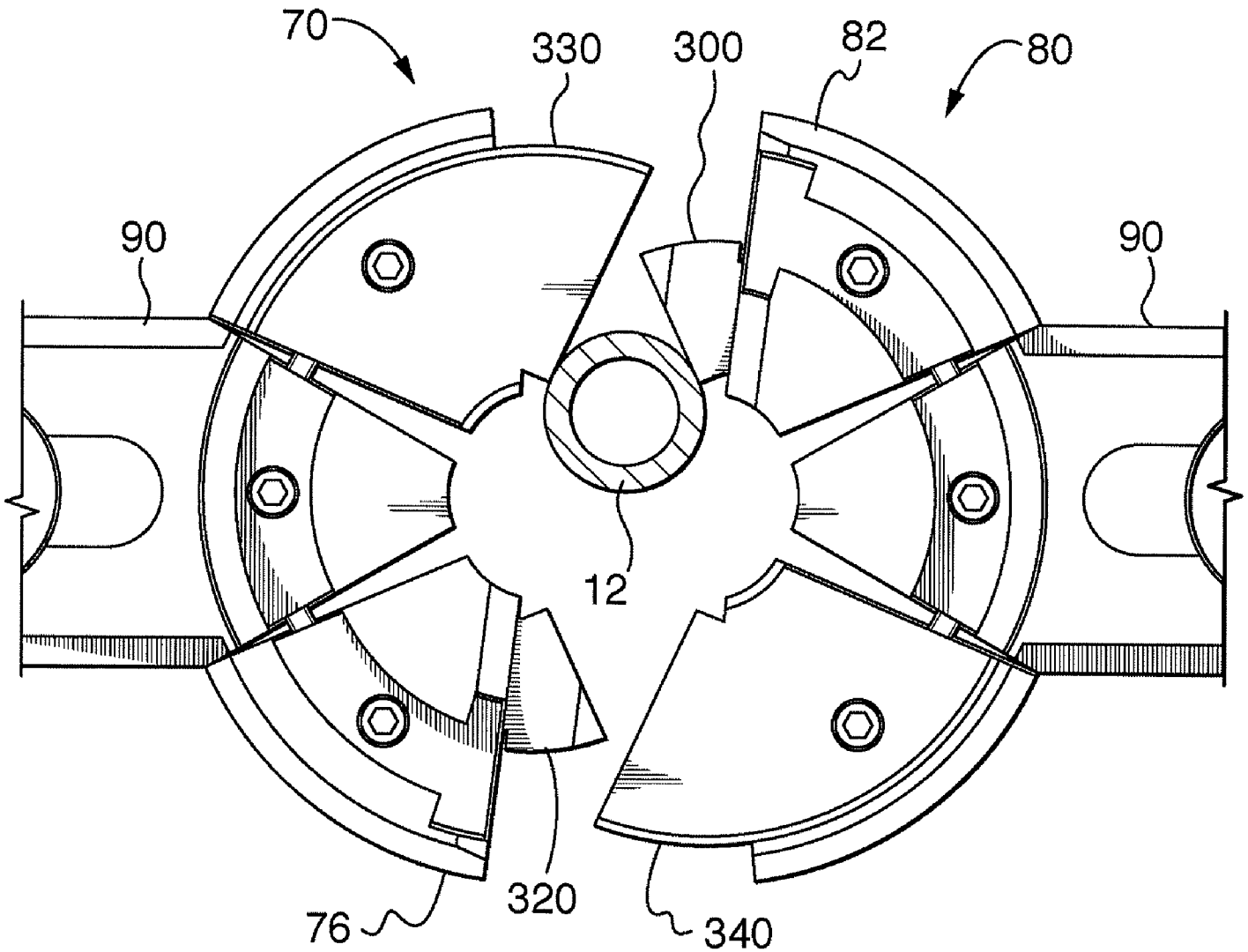
FIG. 9 is a top plan view of slip blocks having pipe guides in accordance with one embodiment of the invention.
Figure 10:
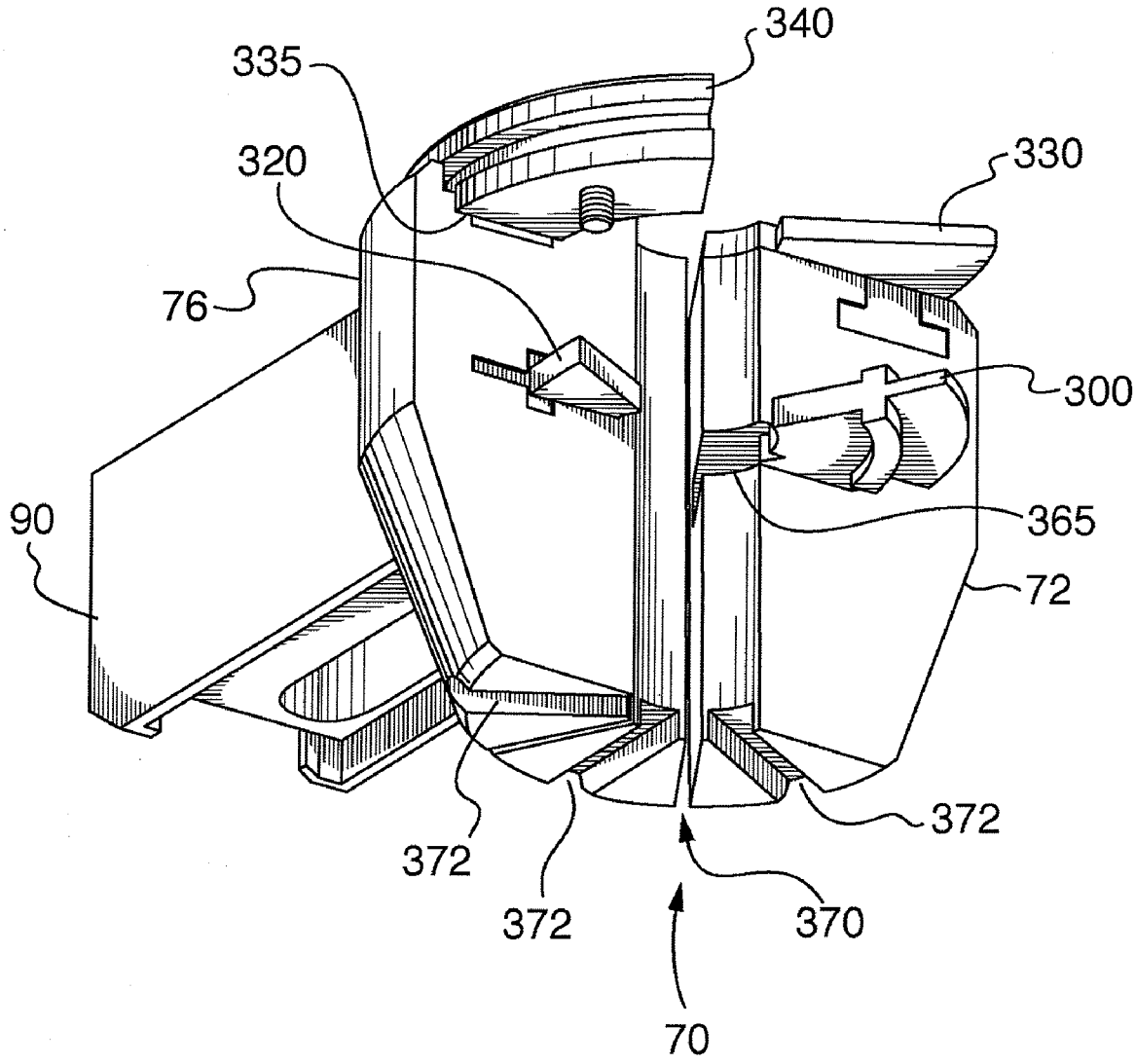
FIG. 10 is an isometric perspective view, as viewed from below, of one of the slip block assemblies having upper and lower pipe guides in accordance with an embodiment of the invention.

Accordingly, as shown in FIGS. 9 and 10, first tubing guide 300, second tubing guide 320, third tubing guide 330 and fourth tubing guide 340 are provided to guide a small tubing string 12 toward a center of the axial passage as the slip block assemblies 70, 80 are moved towards each other. In one embodiment, as shown in FIG. 9, the first tubing guide 300 extends from an exposed face of the side slip 82 while the tubing guide 320 extends from an exposed face of the side slip 76.

As illustrated in FIG. 10, the slip block assemblies include the pair of upper tubing guides, e.g. top tubing plates 330 and 340, and the pair of lower tubing guides, e.g. bottom tubing guides 300 and 320. For the sake of clarity, only one of the two slip block assemblies is shown in FIG. 10. The first slip block assembly 70 has a top tubing guide 340 that extends from a top of the side slip 72 and a bottom tubing guide 300 that extends from the face of the other side slip 76. When the slip blocks are closed, the tubing guides 300, 320 are received in corresponding slots in the opposite slip block assembly 80 (not shown in this figure).

As shown in FIG. 10, when the slip block assemblies 70, 80 are in the loose encirclement of the engaged position, the top tubing guide 330 of the opposite slip block assembly 80 slides over a top 335 in the side slip 76. Likewise, when the slips are in those positions, the bottom, tubing guide 300 of the opposite slip block assembly 80 is received in a correspondingly shaped slot 365 midway up the face of the side slip 72. When the slip block assemblies 70, 80 are moved toward the loose encirclement position and surround the tubing string 12, the guide plates urge the tubing string toward the center of the axial passage. Then, as the slip blocks close around the tubing string 12, the guide plates slide into the corresponding slots in the slip blocks, as described above.

Figure 11:
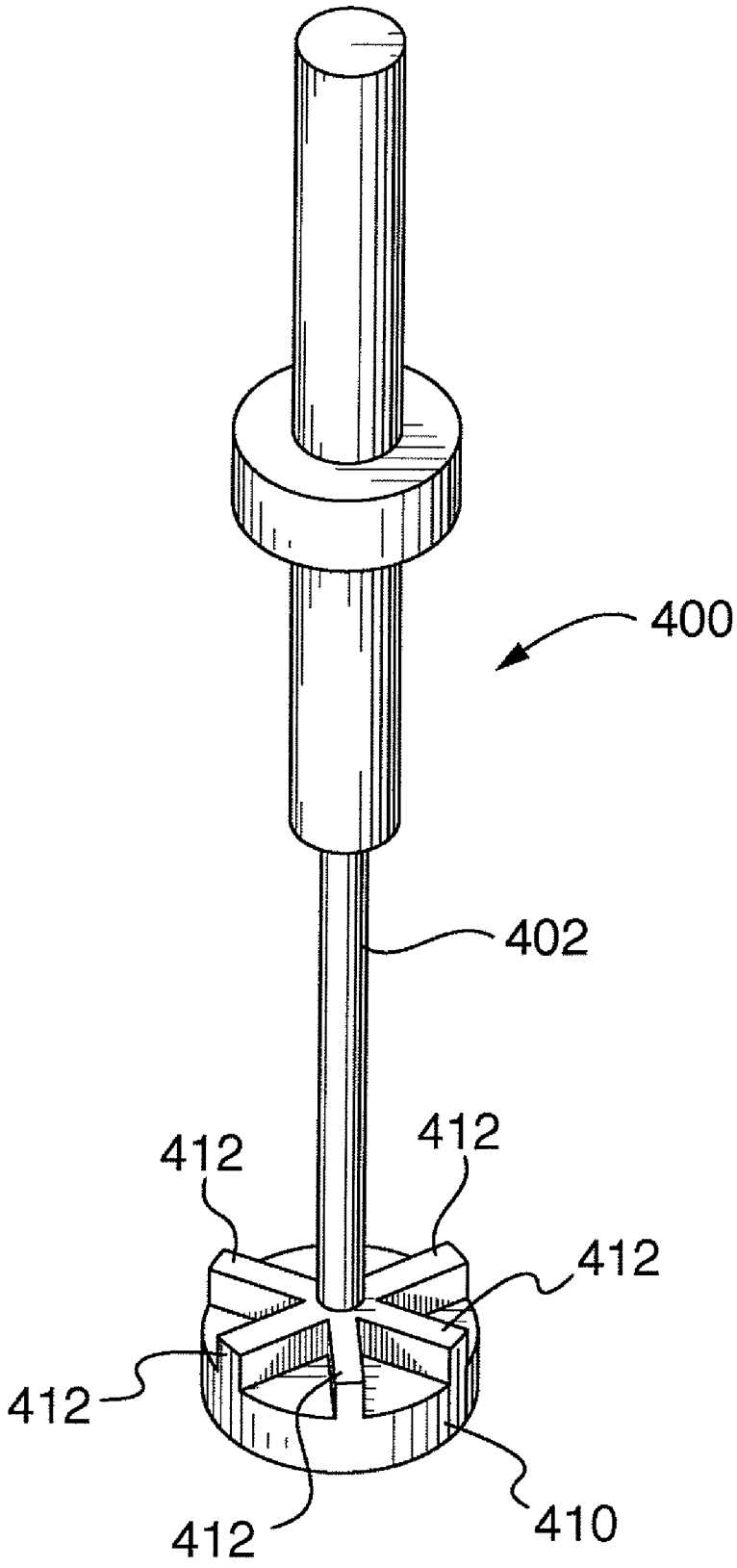
FIG. 11 is an isometric perspective view of a slip assembly tool having a radially ribbed, circular slip support plate for use in changing slips without having to remove the slip spool from the wellhead stack.

A bottom surface 370 of the slip blocks may include one or more radial grooves 372 that cooperate with a complementarily ribbed slip support of a slip assembly tool 400, such as the tool illustrated in FIG. 11. The slip assembly tool 400 has a stem 402 connected to a slip support 410. The slip support 410 has a plurality of radial ribs 412 that are respectively dimensioned to fit in the radial grooves 372 of the slip block assemblies 70, 80. The slip assembly tool 400 permits a field crew to change the slip block assemblies 70, 80 without having to remove the slip spool from the wellhead stack, if required. Slips are typically changed when damaged or a different sized tubing string needs to be supported. As will be appreciated by those skilled in the art, changing slips can be a difficult and time-consuming task, generally requiring removal of the slip spool from the stack. The slip spool 10 and slip assembly tool 400 in accordance with the present invention therefore facilitate the changing of the slip assemblies 70, 80, which thus reduces maintenance expense.

Figure 12:
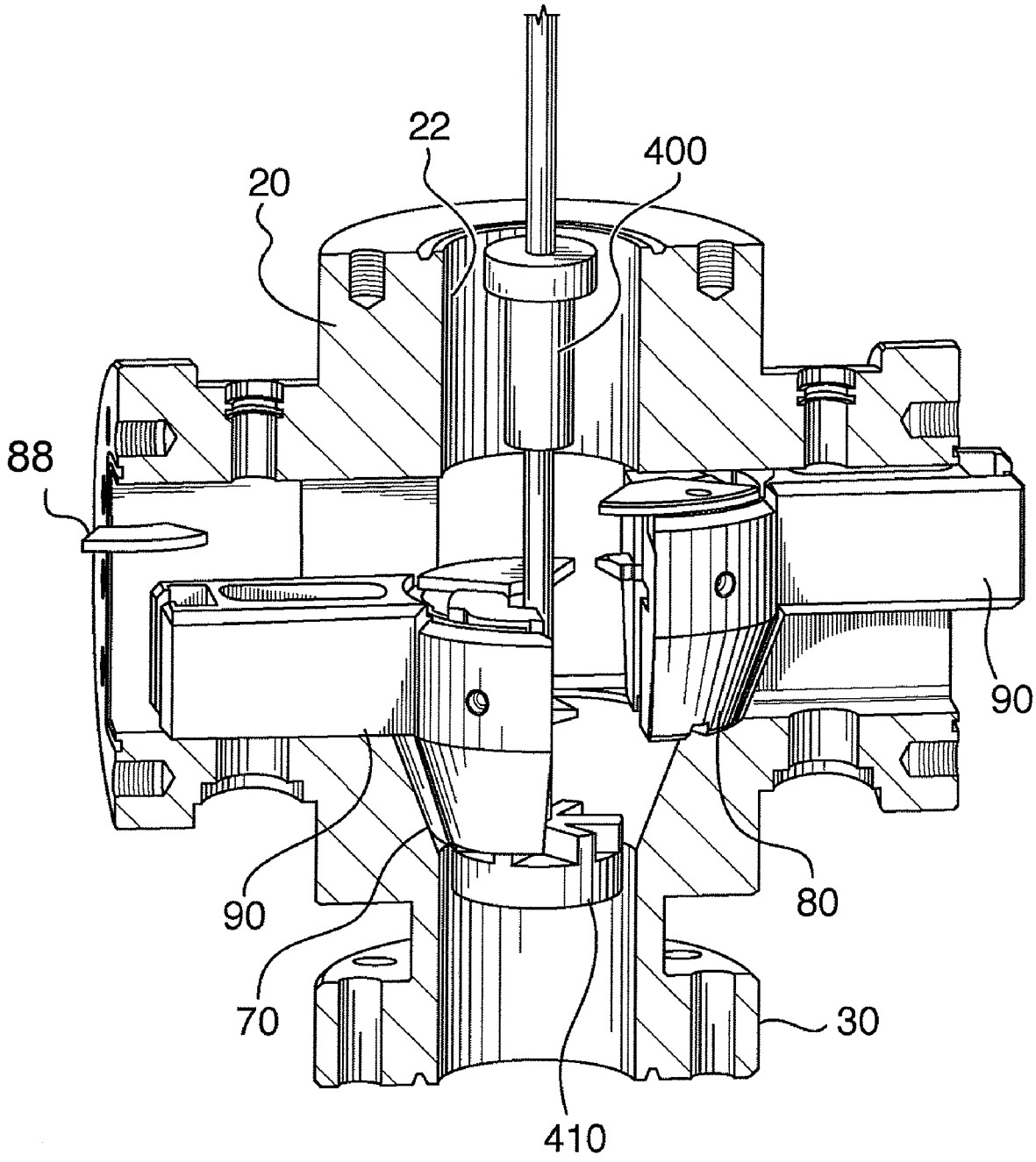
FIG. 12 is a cross-sectional view of the slip spool shown in FIGS. 1-10 illustrating one way in which the slip assembly tool shown in FIG. 11 may be used to change worn or damaged slips.

To replace the slips, the slip block assemblies 70, 80 are first retracted from the axial passage to permit the slip assembly tool 400 to be inserted down the axial passage 22 of the slip spool 10 until the slip support 410 is positioned beneath the slip bowl 28. The slips are closed over the slip assembly tool and surround the stem of the tool. The tool is then rotated until the radial ribs 412 of the slip support 410 are seated within the radial grooves 372 of the slip blocks 72, 74, 76, 82, 84, 86. As illustrated in FIG. 12, one of the slip control arms 90 is then retracted and the other slip control arm 90 is lowered to place the slip assembly 70 into the slip bowl. The retainer plates 88 over the interlock bars are then disconnected and removed through the handle bore as shown in FIG. 12, thus exposing the interlock bars. The side slips 72, 76 can then be lifted through the radial passage using the slip assembly tool 400 to support the side slips and first retracting the center slip 74. New slips can be inserted through the radial passage using the slip assembly tool 400 to support each slip as it is inserted. The slip assembly 70 can be reassembled in an opposite sequence.

In one embodiment of the slip spool 10 in accordance with the invention, the radial actuators 100 are configured to dynamically pressure-balance with existing well pressure. This permits smaller radial actuators 100 to be used since they are not working against well pressure. The axial actuators 202 are pressure-balanced due to identical sealing elements both above and below the radial passages 24 of the slip spool body 20. Since the lift rods 208 extend through the radial passages 24, lifting loads on those actuators are independent of changes in well pressure.

Figure 13:
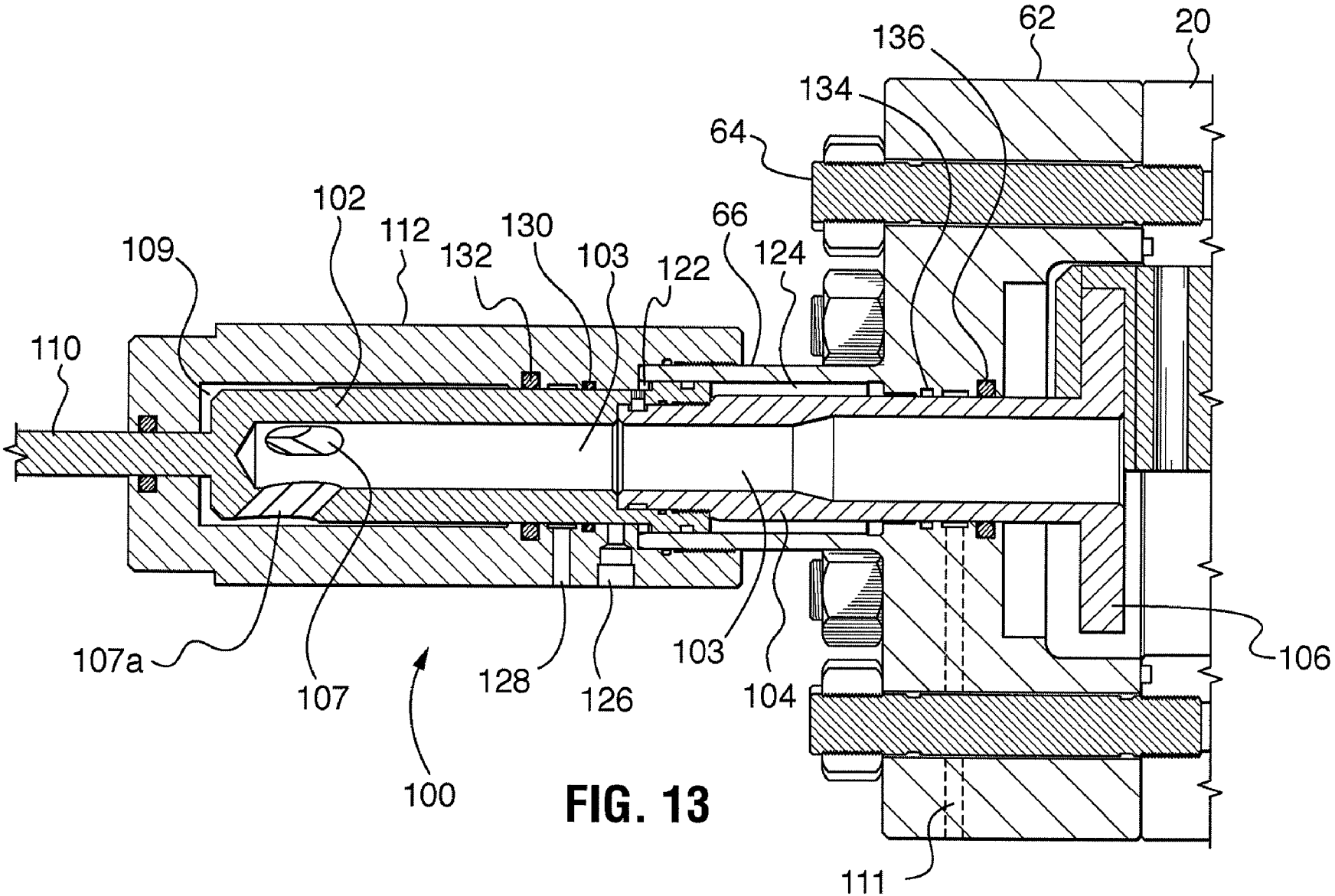
FIG. 13 is a cross-sectional view of a radial actuator in accordance with the invention, to show how a well pressure balance is achieved across the radial actuator.

As illustrated in FIG. 13, the radial actuators 100 are pressure-balanced by "porting" well pressure behind (i.e. outward of) the piston 102 of each radial actuator 100. As shown in FIG. 13, well pressure is "ported" via a longitudinal bore 103 through the piston rod 104 and most of the length of the piston 102. The bore 103 ports well pressure via a piston port 107 that forms an oblique passage **107*a* in fluid communication with an annular gap 109 between the end cap and the annular, radially outward face of the piston 102. The well pressure in gap 109 acts on an annular surface having an area equal to a cross-sectional area of the piston 102 minus a cross-sectional area of the indicator rod 110. This radially inward force is counterbalanced by a radially outward force due to the well pressure acting on an inner annular end of the piston rod 104 which is sized to have substantially the same cross-sectional area. This ensures that the radial actuators 100 operate independently of changes in well pressure and that relatively small (or low-pressure) hydraulic cylinders 112, which include sockets 66, can be used to provide the actuating force, i.e. the radial actuators 100 need not work against well pressure in the slip spool body 20. The piston 102 is reciprocated by hydraulic fluid injected through a first hydraulic port 126 into a first chamber 122 on an outer side of the piston and through a second hydraulic port 127 (FIG. 8) into a second chamber 124 on an inner side of the piston. In one embodiment of the invention, a pressure test port 128 is monitored to detect any leakage of well pressure from the annular gap 109 past a fluid seal 132 and any leakage of hydraulic fluid from the first chamber 122 past a fluid seal 130. In one embodiment, the end plate 62 also includes a pressure-test port 111 that is monitored to detect a failure of fluid-tight seals 134, 136 between the piston rod and the end plate 62. The fluid seal 134 retains hydraulic fluid in the second chamber 124 in front of the piston 102, and the fluid seal 136 inhibits well pressure from migrating from the axial passage 22**.

Although the invention has been principally described with reference to operations in which slips are required to support the weight of a tubular string in a well bore, which is the most commonly encountered condition in well servicing, it should be understood that the apparatus in accordance with the invention can be readily inverted in a well control stack and used as a snubbing unit in a down hole well servicing operation. Alternatively, two slip spools 10 can be mounted back-to-back in a well control stack, with one in an inverted orientation, to provide both snubbing and supporting a tubing string during a well servicing operation. The slip spool 10 can also be used in various other applications required for selectively supporting or snubbing a tubing string suspended in a live well bore.

The embodiments of the invention described above should be understood to be exemplary only. Modifications and improvements to those embodiments of the invention may become apparent to those skilled in the art. The foregoing description is intended to be exemplary rather than limiting. The scope of the invention is therefore intended to be limited solely by the scope of the appended claims.

We claim:

1. A slip spool that selectively supports or snubs a tubing string in a wellbore under pressure, the slip spool comprising:

a slip spool body that is mounted to a wellhead, the slip spool body having an axial passage with a slip bowl formed in the axial passage, and at least two radial passages communicating with the axial passage;

a slip block assembly displaceably supported within each radial passage and displaceable from a cached position in which the slip block assembly clears the axial passage and an engaged position in which slip blocks of the slip block assembly are seated in the slip bowl and cooperate with slip blocks of at least one other slip block assembly to grip the tubing string; and actuators that are operated to displace each slip block assembly from the cached position to the engaged position, and from the engaged position to the cached position.

2. The slip spool as claimed in claim 1 wherein the actuators that displace the respective slip block assemblies comprise:

a radially disposed actuator that radially displaces each slip block assembly between the cached position and a loose encirclement position in which the respective slip block assemblies collectively surround the tubing string; and an axially disposed actuator that axially displaces each slip block assembly from the loose encirclement position to the engaged position in which the slip blocks of the respective slip block assemblies are seated within the slip bowl.

3. The slip spool as claimed in claim 2 wherein the radially disposed actuator comprises a radially disposed hydraulic cylinder mounted to the slip spool body, the radially disposed hydraulic cylinder having a radial piston rod connected to one slip block assembly so that the one slip block assembly can be axially displaced with respect to the hydraulic cylinder by a piston which is connected to the radial piston rod.

4. The slip spool as claimed in claim 3 wherein the axially disposed actuator comprises an axially disposed hydraulic cylinder mounted to the slip spool body, the axially disposed hydraulic cylinder having an axial piston rod connected to the slip block assembly so that the slip block assembly can be axially displaced with respect to the hydraulic cylinder by a piston which it is connected to the axial piston rod.

5. The slip spool as claimed in claim 4 wherein the respective slip block assemblies further comprise a slotted actuating arm including a vertical slot in an outer end thereof and an internal longitudinal slot.

6. The slip spool as claimed in claim 5 wherein the vertical slot is a T-slot permitting the slotted actuating arm to slide axially relative to a plate connected to the radial piston rod and the longitudinal slot permits radial displacement of the slotted actuating arm relative to the axial piston rod, a top end of which extends through the internal longitudinal slot.

7. The slip spool as claimed in claim 2 wherein each slip block assembly comprises a pipe guide that extends peripherally from a face of the slip block assembly, the pipe guide having an angled surface that urges the tubing string toward a center of the axial passage as the respective slip block assemblies are moved to the loose encirclement position.

8. The slip spool as claimed in claim 7 wherein each slip block assembly comprises a slot that receives a pipe guide when the slip block assemblies converge to the loose encirclement position.

9. The slip spool as claimed in claim 1 wherein each slip block assembly comprises three loosely interconnected wedge-shaped slip blocks, and the slip block assemblies collectively grip the tubing string when the respective slip blocks are seated in the slip bowl.

10. The slip spool as claimed in claim 1 wherein each of the slip block assemblies comprises a center slip block and a side slip block loosely connected to each side of the center slip block.

11. The slip spool as claimed in claim 10 further comprising interlock bars loosely fitted within slots in a top end of the side slip blocks and the center slip block to loosely connect the side slip blocks to the center slip block.

12. The slip spool as claimed in claim 11 further comprising a retainer plate connected to respective top ends of the center slip block and of each the side slip blocks to retain respective ends of the interlock bars within the slots in the respective top ends of the center slip block and each of the side slip blocks.

13. A hydraulic cylinder that radially displaces a slip block assembly displaceably supported within a radial passage in a slip spool body, comprising:

a hollow piston rod;

a piston having a hollow inner end to which the hollow piston rod is connected;

a port through the piston that provides fluid communication between the hollow inner end of the piston and an outer side of the piston; and a hydraulic cylinder that surrounds the outer end of the piston;

whereby fluid pressure contained by the slip spool body flows through the hollow piston rod, the hollow inner end of the piston and the port into an annular gap between the outer end of the piston and the hydraulic cylinder to provide fluid pressure balance on opposite ends of the piston and the cylinder rod, thereby reducing a hydraulic force required to displace the slip block assembly.

14. The hydraulic cylinder as claimed in claim 13 further comprising an indicator rod that is connected to the outer end of the piston and extends through a fluid seal in an outer end of the hydraulic cylinder, the indicator rod being displaced with the piston so that an outer end of the indicator rod visually indicates a position of the slip block assembly within the slip spool body.

15. The hydraulic cylinder as claimed in claim 14 further comprising a protective shroud that surrounds the indicator rod, the protective shroud having an oblong aperture that permits the outer end of the indicator rod to be viewed.

16. The hydraulic cylinder as claimed in claim 15 wherein the oblong aperture is dimensioned to correspond to a range of travel of the outer end of the indicator rod and includes gradations to indicate the displacement of the slip block assembly.

17. A slip block assembly for a slip spool, comprising in combination:

a slip control arm with a transverse T-slot in an outer end thereof that slidably receives an end plate connected to a radial actuator that radially displaces the slip block assembly, and an internal longitudinal slot through which extends a lift rod of an axial actuator that axially displaces the slip block assembly, whereby the T-slot and the longitudinal slot decouple axial and radial movement so that the radial actuator can be operated independently of the axial actuator; and at least one slip block connected to an end of the slip control arm and cooperating with at least one other slip block assembly to grip a tubing string that extends through an axial passage in a slip spool body of the slip spool when the slip blocks are displaced into a slip bowl in the axial passage.

18. The slip block assembly as claimed in claim 17 wherein each of the slip block assemblies comprises a center slip block that is integrally formed with the slip control arm and a side slip block loosely connected to each side of the center slip block.

19. The slip block assembly as claimed in claim 18 further comprising a pipe guide that extends peripherally from a face of the slip block assembly, the pipe guide having an angled surface that urges the tubing string toward a center of the axial passage as the at least two slip block assemblies are displaced into the slip bowl.

20. The slip block assembly as claimed in claim 18 further comprising interlock bars received in slots in a top of each slip block to loosely interconnect the side slip blocks to the center slip block.

* * * * *